US006215472B1

(12) United States Patent
Chen

(10) Patent No.: US 6,215,472 B1
(45) Date of Patent: Apr. 10, 2001

(54) DIRECTION CONTROL DEVICE OF A JOYSTICK

(75) Inventor: Nan-Chen Chen, Hsin-Chuang (TW)

(73) Assignee: Sung Forn Co., Ltd., Taipei (TW)

( * ) Notice: Subject to any disclaimer, the term of this patent is extended or adjusted under 35 U.S.C. 154(b) by 0 days.

(21) Appl. No.: 09/118,092

(22) Filed: Jul. 17, 1998

(51) Int. Cl.[7] ..... G09G 5/08
(52) U.S. Cl. ..... 345/161; 345/157
(58) Field of Search ..... 345/156, 157, 345/161, 164, 165, 163; 74/471 XY; 250/221; 200/6 R, 6 A; 463/38

(56) References Cited

U.S. PATENT DOCUMENTS 5,640,177 * 6/1997 Hsu ..... 345/161
5,675,359 * 10/1997 Anderson ..... 345/161
5,742,278 * 4/1998 Chen et al. ..... 345/156

* cited by examiner

*Primary Examiner*—Xiao Wu
(74) *Attorney, Agent, or Firm*—Bacon & Thomas, PLLC

(57) ABSTRACT

A direction control device of a joystick includes a joystick seat, a hemispherical joystick structure, a U shape piece, a substrate, and two fan-shaped encoder structures. At least two infrared detectors are installed on each side of each of the fan-shaped encoder structures. When one set of the infrared detectors has detected movement of openings in the encoder structures, the signals 0 and 1 will be generated and used to control the positions of the coordinate axes of the joystick. When the joystick is released, the encoder structures will return to a central point at which a second set of the encoder structures detects reset holes positioned above the openings in the fan-shaped encoder structures.

4 Claims, 8 Drawing Sheets

| | | | |
|---|---|---|---|
| 0 | 0 | 1 | 1 |
| 1 | 0 | 0 | 1 |

DIRECTION CONTROL DEVICE OF A JOYSTICK

BACKGROUND OF THE INVENTION

1. Field of the Invention

The present invention relates to a structure of the direction control device of a joystick, and especially to a double axes input means with two infrared detector sets which are preferably used in the direction control of a joystick.

2. Background of the Invention

In the prior-art joystick, the movement of the joystick is controlled linearly, that is, the data of X axis and Y axis are obtained by modulating through a varied resistor. It is desired to obtain the input data of X axis and Y axis to plot a vector of absolute linear coordinates (as shown in FIG. 1). In that, the original point (0, 0) is installed on the center, for example (50, 50), of a vector of absolute linear coordinates so that it may be correspondent to any point of display screen.

But the resistance of a varied resistor is adjusted by the rotation of a resistor adjusting rod, thus the linear absolute coordinate vector formed by the resistance thereof can not attain the object of a linear vector. Instead, it is presented as a vector of absolute nonlinear coordinates, as the points b and c shown in FIG. 1—1. Thus, a manual fine adjustment is necessary to reset the device (as shown in FIG. 1–2). Although the original point may thereby be reset, the obtained absolute coordinate vector figure is still nonlinear, i.e. the ideal condition shown in FIG. 1 can not been presented. Furthermore, after a long period of rotation of the varied resistance, the carbon film is easy to break through extended periods of contact and friction, the correct resistance will be lost. Accordingly, the of correctness of nonlinear vector figure is further effected.

Since the prior-art joystick varies the linear signal due to the friction of the varied resistance, and each time, a fine adjustment is needed to reset the device, it is necessary to provide an improved structure of the direction control device of a joystick. By a ⟷ shape opening, a central reset hole and two infrared detector sets, when the infrared detectors have detected the movement of the fans, the signals 0 and 1 will be generated and used as data for controlling the X axis and Y axis about the direction of the joystick. When the joystick has been released, the fan shaped encoder structures of the input axes will be recycled back to the central point so that another infrared detector will pass through a reset hole. Thus, the present invention may be controlled sensitively and has a precise reset effect.

SUMMARY OF THE INVENTION

Accordingly, the primary object of the present invention is to provide a structure of the direction control device of a joystick which may be controlled sensitively and may be precisely reset.

A further object of the present invention is to provide a structure of the direction control device of a joystick, wherein the two sides of each input encoder are installed with at least two infrared detectors.

Another object of the present invention is to provide a structure of the ideal linear direction control device of a joystick.

A structure of the direction control device of a joystick of the present invention comprises a joystick seat, a hemispherical joystick, a U shape piece, a substrate, and two fan shaped encoder structures for of the input axes, wherein a through hole is installed on the central portion of the joystick seat and four pivotal portions forming a rectangle are extended downwards from the periphery of the through hole, wherein two tightly adjacent engaging portions are installed on the proper positions inside the pivotal portion of one of the pivotal portions for engaging with a spring sleeve having a spring; and wherein the encoders are engaged on sides of the hemispherical joystick and the U shape piece, respectively. Long push pieces are installed on opposite sides of the hemispherical joystick and the U shape piece. When the joystick is released, by the pivotal portion of the joystick seat, the hemispherical joystick and the U shape piece are positioned. Moreover, at least two infrared detectors are installed on two sides of the substrate with respective to each encoder structure.

The present invention will be better understood and its numerous objects and advantages will become apparent to those skilled in the art by referencing to the following drawings in which:

BRIEF DESCRIPTION OF THE DRAWINGS

FIG. 1-1 is a practical vector of a prior-art joystick.

FIG. 1-2 shows a manual adjustment necessary to reset a prior-art joystick.

FIG. 2 is a perspective view of the present invention.

FIG. 6-1 is a schematic view of the fans and the infrared detectors of the present invention.

FIG. 6-2 is a side view of the fans and the infrared detectors of the present invention.

FIG. 6-3 shows the four sets of signals 0 and 1 generated by the fans and the infrared detectors.

FIGS. 6-4 and 6-5 show the absolute coordinate of the four quadrants formed in the present invention.

DETAILED DESCRIPTION OF THE PREFERRED EMBODIMENT

Figure 1:
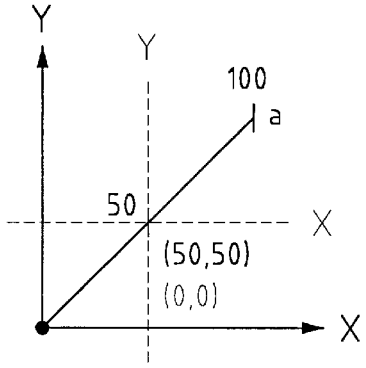
FIG.1 PRIOR ART
FIG. 1 shows the vector of the linear absolute coordinate of a joystick in an ideal condition.
Figure 1:
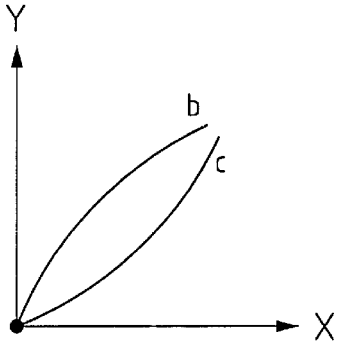
FIG.1-1 PRIOR ART
Figures 1, 2:
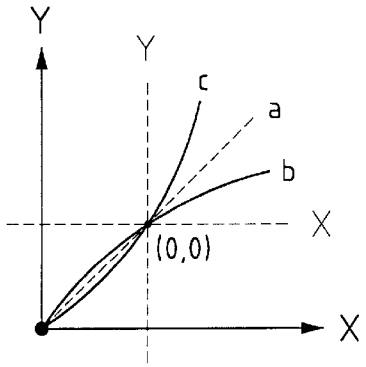
FIG.1-2 PRIOR ART
Figure 2:
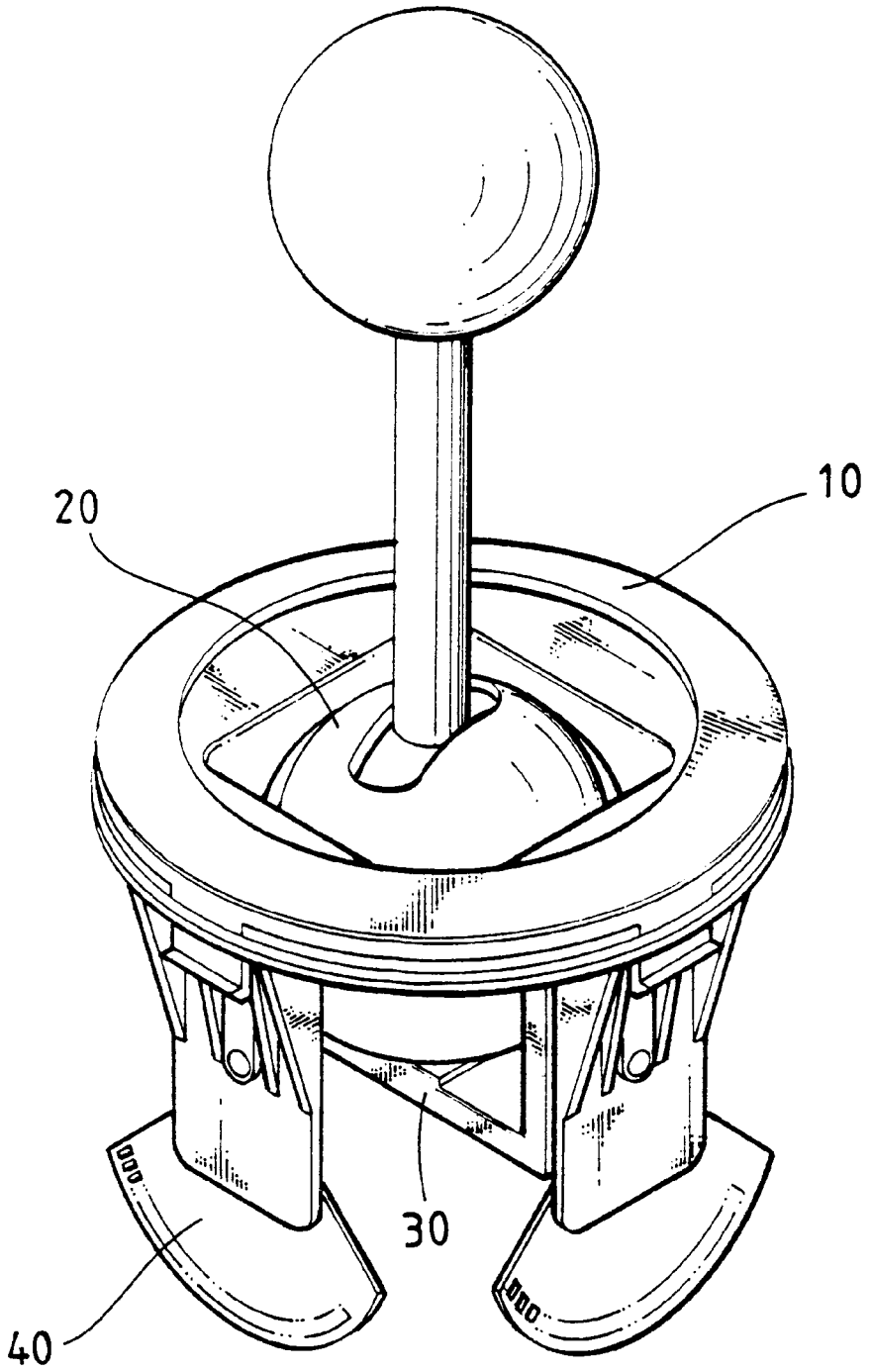
Figure 3:
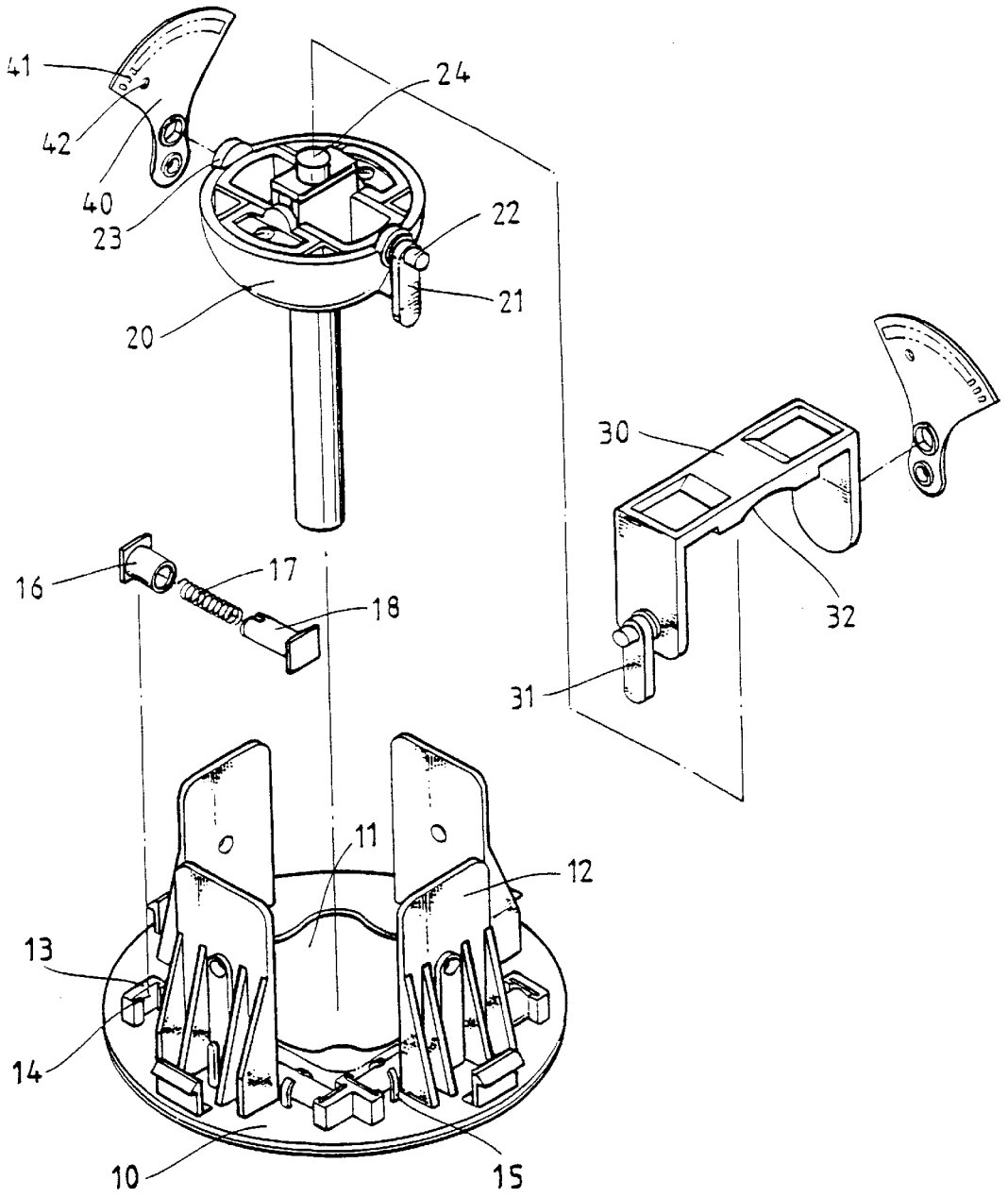
FIG. 3 is an exploded view of the present invention.
Figure 4:
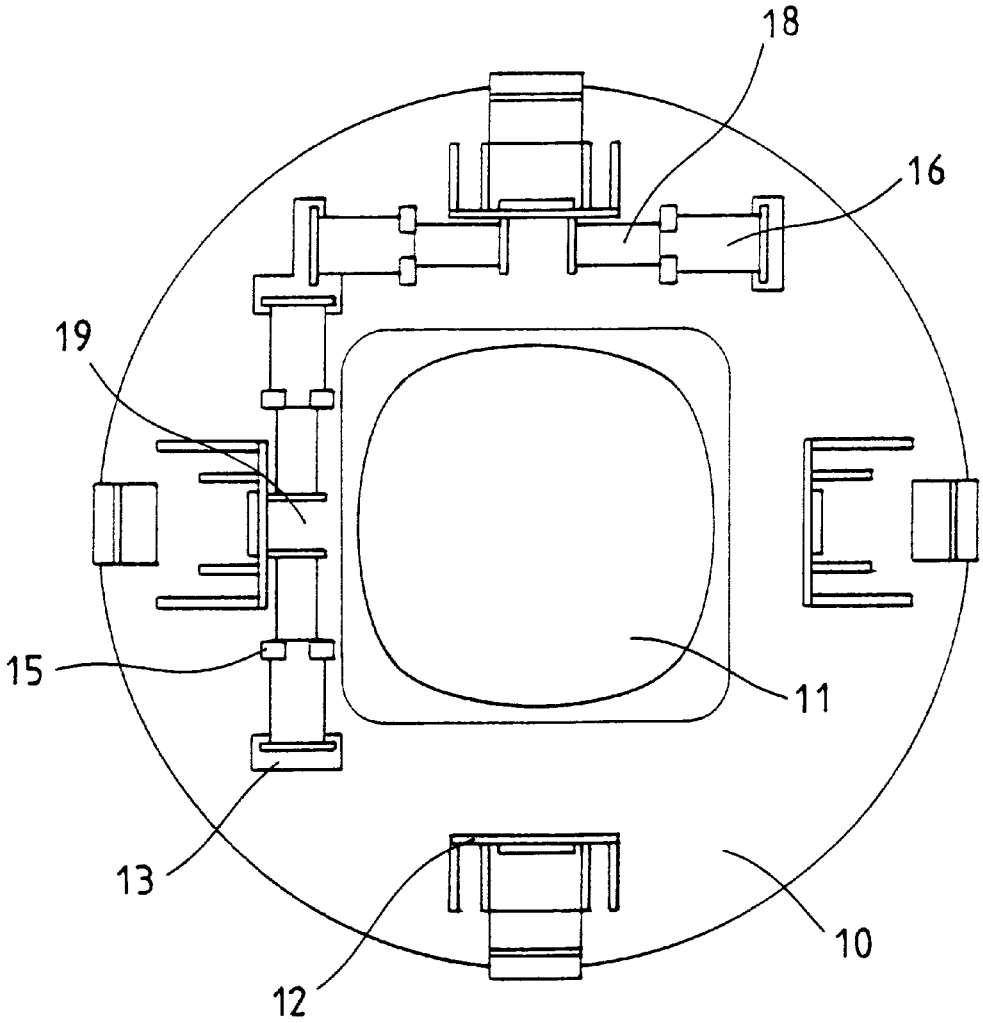
FIG. 4 is an elevational view of the joystick seat in the present invention.

As shown in FIGS. 2, 3 and 4, the direction control device of a joystick of the present invention comprises an infrared detector seat 10, a hemispherical joystick 20, a U shape piece 30, a substrate 50 and two fan-shaped encoder structure 40; wherein the joystick seat 10 is formed by a round piece having a projected hook to engage with a circular piece the central portion of which is installed with a central through hole 11. The central through hole 11 is extended inwards and the four angles thereof are formed as a guiding cambered angle. Four pivotal portions 12 forming a rectangular are vertically extended downwards from the periphery of the central through hole 11. An axial hole is installed at the proper position of the of center of pivotal portions 12. Two tightly adjacent engaging portions 13 are installed on the front two ends on one set of adjacent pivotal portions 12, and two engaging blocks 15 are installed between the engaging grooves 14 of two engaging portions 13 for being engaged with a preset spring 17. The inner and outer bushes 16 and 18 are engaged with the spring 17 and the spring may slide forwards and backwards within the spring.

Extended blocks 23 are installed on the medium portions of the left and right sides of the hemispherical joystick 20.

A long push piece 21 is installed on one side of the extended block 23. Each of the upper and lower ends of the extended block 23 and the distal end of the push piece 21 is installed on a pivotal axis 22 having engaging surfaces of stepped shape. The lower portion of the joystick is installed with a central convex axis 24 having a central convex pillar.

An upwards convex rectangular frame is installed on the central connecting portion of the U shape piece 30. A cambered concave portion is installed on the central portion of the frame and a center axial hole 32 (not shown) is installed on the inner part thereof A long push piece 31 extended downwards 31 is installed on the short edge of the U shape piece 30 and an engaging axis having an engaging surface with a step shape is installed on the upper end of the push piece 31. The engaging axes having engaging surfaces with a stepped shape are installed on each of the upper and lower ends on the long edge of another side thereof.

A plurality of ⟷ shape openings 41 aligned in order from left side to right side are installed near the distal end of the encoder structure 40. Also, a reset hole 42 is installed on the proper position near the ⟷ shape hole, while two upper and lower axial holes with different sizes are installed on the distal end of the encoder shaft.

The spring 17 is put into the inner busing 18, the outer busing is used to cover the structure, and then the bushing are embedded between the engaging block 15 and the engaging groove 14 of the engaging block 13 so that a space 19 is maintained between the two bushings. Moreover, the two fan-shaped encoder structures 40 are engaged on the upper and lower pivotal axes of the hemispherical joystick 20 and the U shape piece 30, and then the hemispherical joystick 20 is further penetrated through the central through hole 11 of the joystick seat 10 so that the push piece 21 of the hemispherical joystick 20 will be located on the space 19 between the two bushes of the infrared detector seat 10, and the pivotal axes 22 on the two sides thereof are embedded into the axial holes of the pivotal portion 12 of the joystick seat 10, while the push piece 31 of the U shape piece is located on the space 19 of another two adjacent bushes and then is engaged on the axial holes of another two of the supporting plates 12. The central axial hole 32 on the medium connecting portion of the U shape piece 30 is covered on the central convex axis 24 on the bottom portion of the hemispherical joystick 20. Therefore, the assembly of the push piece is completed.

Figure 5:
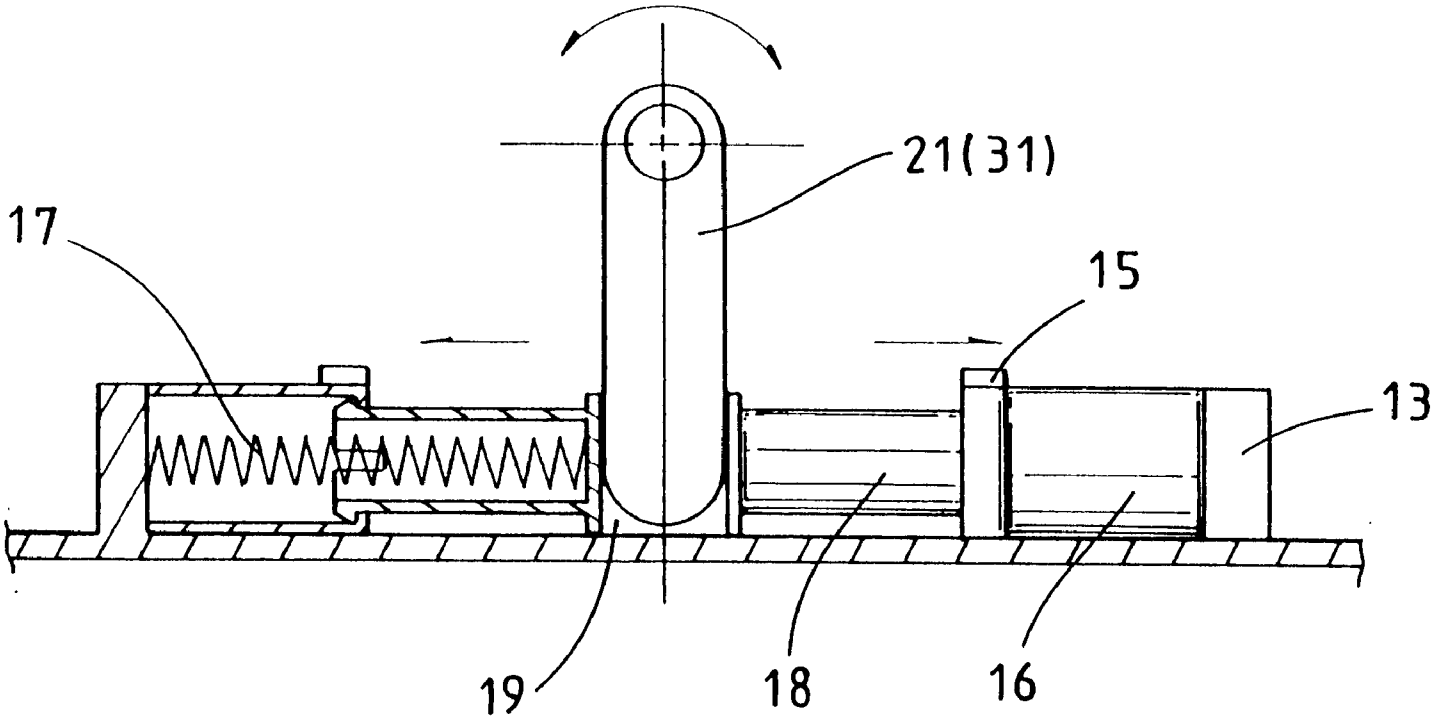
FIG. 5 is a cross sectional view of the push piece of the present invention.
Figures 1, 6:
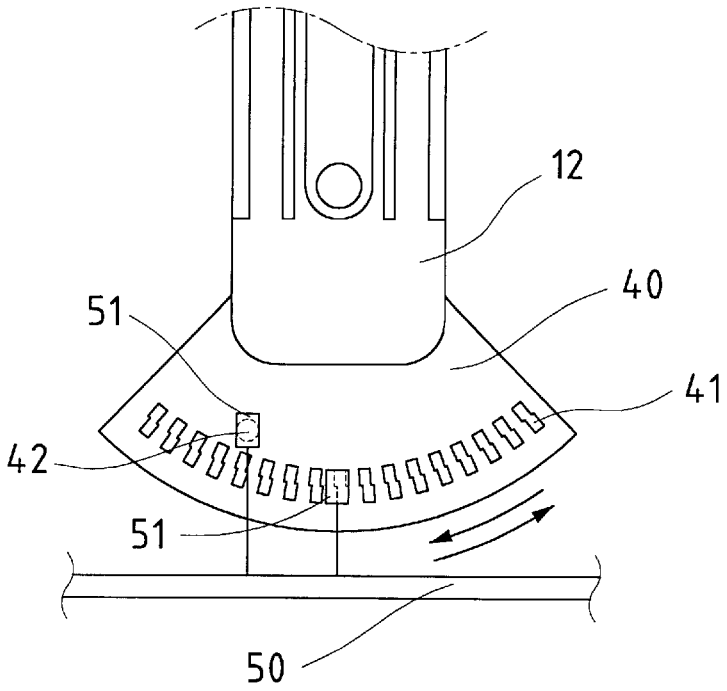
Figures 2, 6:
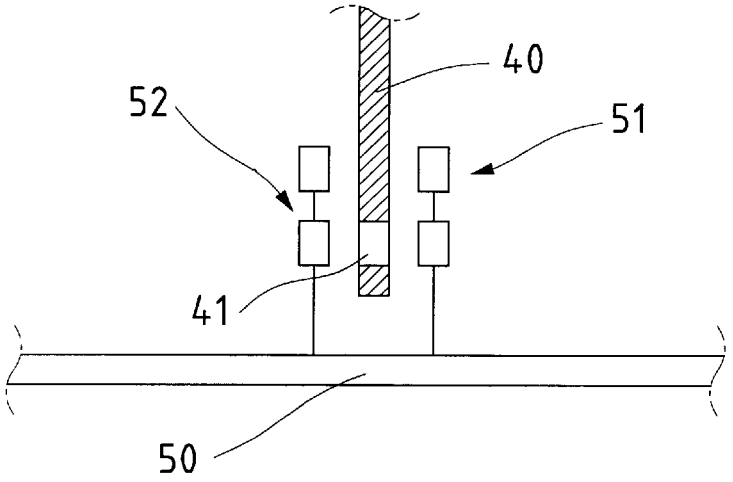
Figures 3, 4, 6:
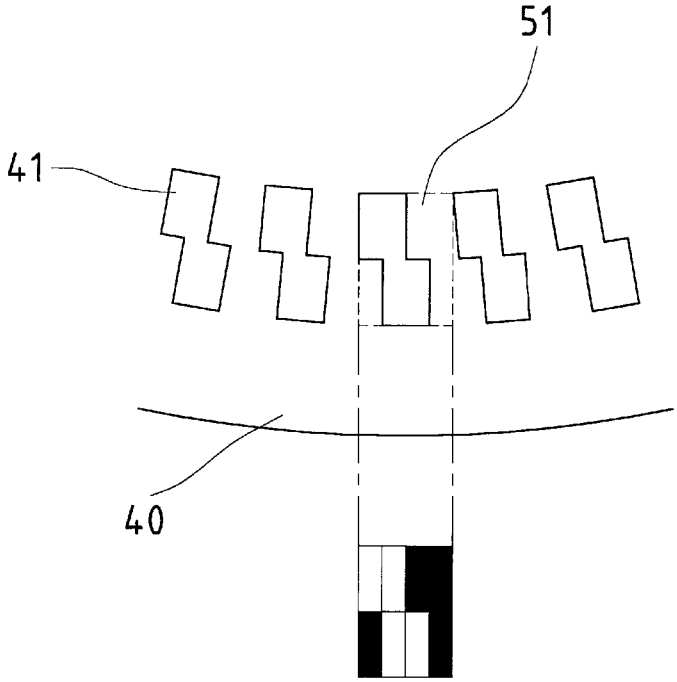
Figures 5, 6:
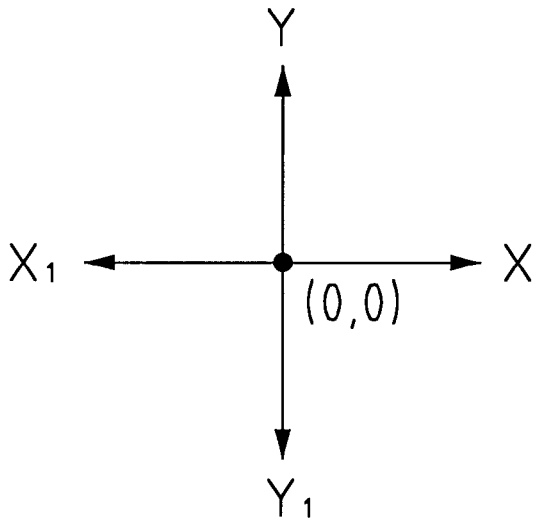

Referring to FIGS. 6-1 and 6-2, the encoder structures are installed between the infrared detector sets 51 and 52, the height of one of the infrared detector sets corresponding to that of the ⟷ shape opening 41 on the structure 40, and the other infrared detector set is installed for matching with the size of reset hole 42. When the joystick shakes, the push pieces 21 and 31 (as shown in FIG. 5) between the bushing will be arranged so that the encoder structures in another side will move. Thereby, the ⟷ shape opening and infrared detectors will generate four kinds of signals 0 and 1 (as shown in FIG. 6-3), and thus these two sets of signals may be used to control the X axis and Y axis of the direction of the joystick. Since the central point of the two encoder structures 40 is the point of origin they may form an absolute coordinate with four quadrants (as shown in FIG. 6-4). When the joystick is released, by the opposite force of the bushings, the push pieces 21 and 31 of the two encoder structures 40 will cause the reset holes 42 of the two encoder structures face to another set of infrared detectors. If the light of this infrared detector set has not been obstructed, the joystick has returned to the original point.

In summary, in the direction control device of the joystick of the present invention, two infrared detector sets have been installed on the two sides with respective fan-shaped encoder structures. By the movement of the encoder structures the infrared receivers will record the signals 0 and 1 formed by the infrared detectors and the ⟷ shape opening. Thus, the joystick has an absolute coordinate for corresponding to any point on the screen. Meanwhile, after the joystick is released, the encoder structures of the two input axes are returned to the original position so that the reset hole will pass through another infrared detector set. Thus, the object of precise reset is attained. Thus the direction control device of a joystick of the present invention has been further improved than the prior-art direction control device of a joystick.

Although a certain preferred embodiment of the present invention has been shown and described in detail, it should be understood that various changes and modification may be made therein without departing from the scope of the appended claims.

What is claimed is:

1. A structure of a direction control device of a joystick, comprising a joystick seat, a hemispherical joystick structure, a U shape piece, a substrate, and two fan-shaped encoder structures, wherein a central portion of the hemispherical joystick structure is installed with a through hole, four pivotal portions forming a rectangle are sequentially extended downwards from the periphery of the through hole, two closely adjacent engaging portions are installed on inside one of the pivotal portions for engaging a spring sleeve having a spring, the encoder structures are engaged on respective sides of the hemispherical joystick structure and the U shape piece, long push pieces are installed on respective opposite sides of the hemispherical joystick structure and the U shape piece, the hemispherical joystick structure and the U shape piece are actively connected at a predetermined position by a pivotal portion of the joystick seat, and at least two infrared detectors are installed on each side of each of the fan-shaped encoder structures, wherein a plurality of ⟷ shape openings are installed in the fan-shaped encoder structure, and reset holes are installed in the fan-shaped encoder structures at positions above the openings, wherein the ⟷ shape openings are installed unidirectionally, and wherein the infrared detectors are installed at positions corresponding to positions of the ⟷ shape openings and the reset holes.

2. The structure of the direction control device of a joystick as recited in claim 1, wherein a vertical supporting plate is installed in the pivotal portion of the joystick seat, and an axial hole is installed on the supporting plate.

3. The structure of the direction control device of a joystick as recited in claim 1, wherein the engaging portions of the joystick are engaging blocks having inner engaging grooves, while two opposite engaging blocks are installed therebetween.

4. The structure of the direction control device of a joystick as recited in claim 1, wherein each of the engaging portions is arranged to engage two bushings, and a space is formed between the two bushings for matching with the hemispherical joystick and the U shape piece.

* * * * *